US011488430B2

(12) United States Patent
Buttolo et al.

(10) Patent No.: US 11,488,430 B2
(45) Date of Patent: Nov. 1, 2022

(54) SYSTEMS AND METHODS FOR WINDOWS AS A MICROPHONE KEYPAD ENTRY

(71) Applicant: Ford Global Technologies, LLC, Dearborn, MI (US)

(72) Inventors: Pietro Buttolo, Dearborn Heights, MI (US); Joshua Wheeler, Trenton, MI (US); Scott Andrew Amman, Milford, MI (US); Nicholas Colella, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/063,209

(22) Filed: Oct. 5, 2020

(65) Prior Publication Data

US 2022/0108574 A1 Apr. 7, 2022

(51) Int. Cl.
*G07C 9/00* (2020.01)
*G07C 9/37* (2020.01)

(52) U.S. Cl.
CPC ..... *G07C 9/00563* (2013.01); *G07C 9/00658* (2013.01); *G07C 9/00896* (2013.01); *G07C 9/37* (2020.01); *G07C 2009/00746* (2013.01)

(58) Field of Classification Search
CPC ... G07C 9/00563; G07C 9/37; G07C 9/00896
See application file for complete search history.

(56) References Cited

U.S. PATENT DOCUMENTS

| | | | | |
|---|---|---|---|---|
| 6,356,641 | B1 | 3/2002 | Warnaka et al. | |
| 8,180,065 | B2 | 5/2012 | Snider | |
| 9,548,053 | B1 * | 1/2017 | Basye | G06F 16/683 |
| 10,479,300 | B2 | 11/2019 | Wheeler et al. | |
| 2012/0229253 | A1 * | 9/2012 | Kolar | B60R 25/257 340/5.61 |
| 2014/0285320 | A1 * | 9/2014 | Blackmer | B60R 25/23 340/5.72 |
| 2019/0106069 | A1 * | 4/2019 | Wheeler | G01H 11/00 |

OTHER PUBLICATIONS

Bolzmacher, et al., "Transforming Car Glass Into Microphones Using Piezoelectric Transducers", Microsystem Technologies, Jul. 2016.

* cited by examiner

*Primary Examiner* — Daniell L Negron
(74) *Attorney, Agent, or Firm* — Frank Lollo; Eversheds Sutherland (US) LLP

(57) ABSTRACT

Disclosed is a system that uses a window as a microphone as a replacement for keyless entry to a vehicle. The system includes a window which acts as a microphone using a piezoelectric transducer that captures resonance on an outside surface of the vehicle window when pressure waves (e.g., voice commands or taps) impact it. To recognize this sound, a transducer controller amplifies vibrations from the window tap or spoken commands. The system may include a low-power mode that listens for input while the vehicle is off. In a second, high-power mode, the system may detect a tapping event, which may prompt a transition to a wake-up state. The system may associate a number and timing of taps with unique user keys, similar to key selections of numbers on a keypad. The system may also recognize verbal PIN code input using the piezoelectric transducer microphone.

18 Claims, 5 Drawing Sheets

SYSTEMS AND METHODS FOR WINDOWS AS A MICROPHONE KEYPAD ENTRY

BACKGROUND

Vehicle users widely appreciate the ability to enter a vehicle using a keypad. They appreciate the convenience of leaving keys inside the vehicle or the ability to enable guests/children to access the vehicle without giving them the keys.

First generation keypads used mechanical buttons, which were bulky, aesthetically unappealing, and susceptible to weather conditions. Current keypads use capacitive technology, which addresses many of these issues. Nevertheless, there is a need for improved keypad entry systems. It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Disclosed are systems and methods that use a vehicle window as a microphone, as a replacement for keyless entry to a vehicle. In some embodiments, the system can include a window configured to operate as a microphone, using a piezoelectric transducer that captures resonance on an outside surface of the vehicle window when pressure waves (e.g., voice commands or taps) impact the window glass. To recognize this sound, a transducer controller amplifies vibrations from the window tap or spoken commands.

In some instances, the system may include a low-power mode that listens for input while the vehicle is off. In a high-power mode, the system may detect a tapping event, which may prompt a transition to a wake-up state. The system may associate a number and timing of taps with unique user keys, similar to key selections of numbers on a keypad.

In other instances, the system may recognize a verbal input that includes a spoken PIN code. The system may utilize the piezoelectric transducer microphone inside the window glass to receive and amplify speech through vibrations received.

The piezoelectric diaphragm transducer system may allow a secondary use of automotive glass to function as a keypad for a keyless vehicle entry system. In some aspects, the disclosed system may not rely on capacitive or mechanical buttons disposed on vehicle exterior surfaces that may wear over time and increase vehicle cost. Moreover, vehicle styling may be improved without unsightly keypad interfaces on the vehicle doors or other surfaces.

In other aspects, the disclosed systems and methods may enable additional user-friendly vehicle features without increasing vehicle cost, such as a vehicle security feature where the system recognizes tapping, then enables the entry system to transition from a low-power mode to a high-power mode for receiving verbal commands to unlock the vehicle. In still other aspects, the system may provide tactile feedback after entry of each digit when the window tapping feature is utilized.

These and other advantages of the present disclosure are provided in greater detail herein.

Illustrative Embodiments

The disclosure will be described more fully hereinafter with reference to the accompanying drawings, in which example embodiments of the disclosure are shown, and not intended to be limiting.

Figure 1:
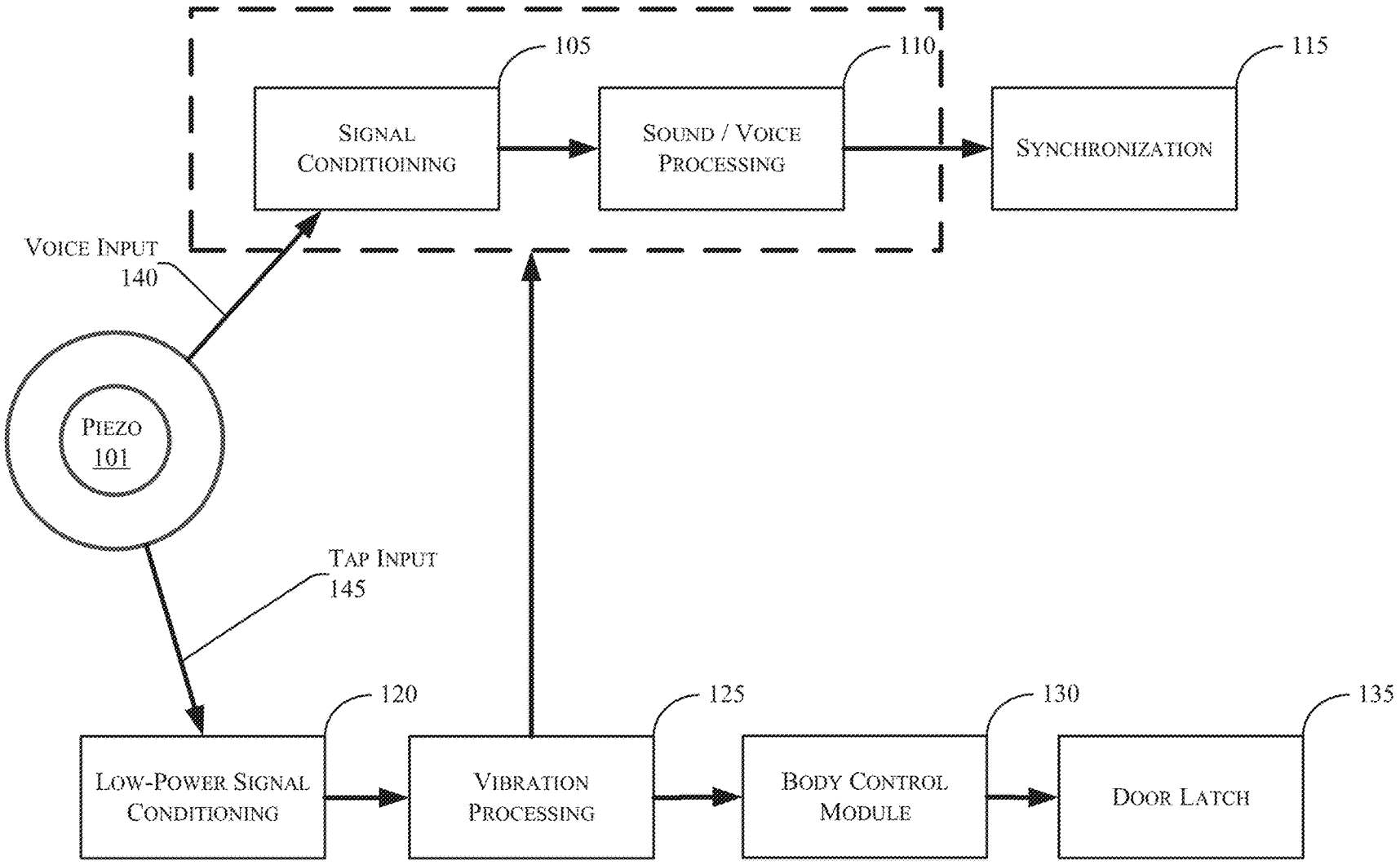
FIG. 1 depicts an example flow diagram for using an access control system to provide user access to a vehicle using a piezoelectric diaphragm transducer microphone in accordance with embodiments of the present disclosure.

FIG. 1 illustrates an example process diagram for using an access control system to provide user access to a vehicle, in accordance with example embodiments of this disclosure.

To recognize sound external to the vehicle, including voice commands, the sound signal must be amplified to a sufficient level for processing onboard the vehicle. This type of processing may require power consumption that would drain the vehicle battery if a signal conditioning module 105 and a sound/voice processing module 110 were left running while the vehicle is keyed off.

A piezoelectric diaphragm transducer microphone 101 may be disposed in communication with and/or be a part of a vehicle access system. The piezoelectric diaphragm transducer microphone 101 may communicate with a signal conditioning module 105 and a low-power signal conditioning module 120. The system may use the piezoelectric diaphragm transducer microphone 101 to receive tap inputs 145 and voice inputs 140 resonating through automotive glass to provide vehicle access. The piezoelectric diaphragm transducer microphone 101 may be or include a transducer assembly configured to act as a weather-resistant solid-state microphone device that is mountable on a vehicle interior or exterior, in locations that may normally be unsuitable for microphones or other input devices, such as the engine compartment, or in the present embodiment, in automotive glass. The transducer assembly may include a piezoelectric actuator, such as the type conventionally used in small consumer electronics to produce beeps, chirps, or other sound output, or may be configured and/or programmed as another type of piezoelectric microphone unit. The piezoelectric diaphragm transducer microphone 101 may be rigidly mountable to a resonating surface, such as an automobile window, and may be programmed to use the window to receive sound vibrations and taps that cause the piezoelectric diaphragm transducer microphone 101 to produce a piezo-transducer signal for processing by an automotive computer using the signal conditioning module 105 and/or the low-power signal conditioning module 120.

The piezoelectric diaphragm transducer microphone 101 may detect vibration inputs through the automotive window glass that cause the system to utilize one or more of two logical paths using the piezo-transducer signal. The uppermost process blocks illustrated include the signal conditioning module 105 and a sound/voice processing module 110, which may each be maintained in a low-power or dormant state while the vehicle is keyed off. The second path, shown on the bottom row of FIG. 1, includes the low-power signal conditioning module 120, a vibration processing module 125 disposed in communication with the low-power signal conditioning module 120, a body control module (BCM) 130 in communication with the vibration processing module 125, and a door latch mechanism 135 disposed in communication with the BCM 130.

In some aspects, the piezoelectric diaphragm transducer microphone 101 may be tuned and/or programmed to detect finger tapping on the window(s) in the proximity of the piezoelectric diaphragm transducer microphone 101. Because the vibrations/sound waves associated with a tap on the glass are considerably stronger (e.g., have a higher amplitude) as compared to vibration induced by spoken sound waves, the system may require a significantly lower power requirement to power the standby processor associated with the low-power signal conditioning module 120. Further, the signal conditioning module 105 may require significantly less power to detect and/or process a window tap, and therefore the signal conditioning module may be kept in an active mode while the vehicle is off.

In another example embodiment, the low-power signal conditioning module 120 may receive a tap input 145, which acts as a wake-up signal. Responsive to receiving the wake-up signal, the vibration processing module 125 may transmit a wake-up signal to the signal conditioning unit 105 and the sound/voice processing module 110.

In another embodiment, responsive to the vibration processing module 125 detecting a tapping event, it may send a request message to wake-up the sound/voice processing module 110. Once awake and in a high-power mode, the sound/voice processing module 110 may allow the user to enter voice input to request entry. In other aspects, responsive to recognizing a known sequence of taps or a verbal utterance associated with a valid PIN code, the vehicle may trigger the body control module 130 to provide access to the vehicle by generating an unlock control signal that causes the door latch mechanism 135 to provide vehicle access to the user by unlocking the door(s).

Figure 2:
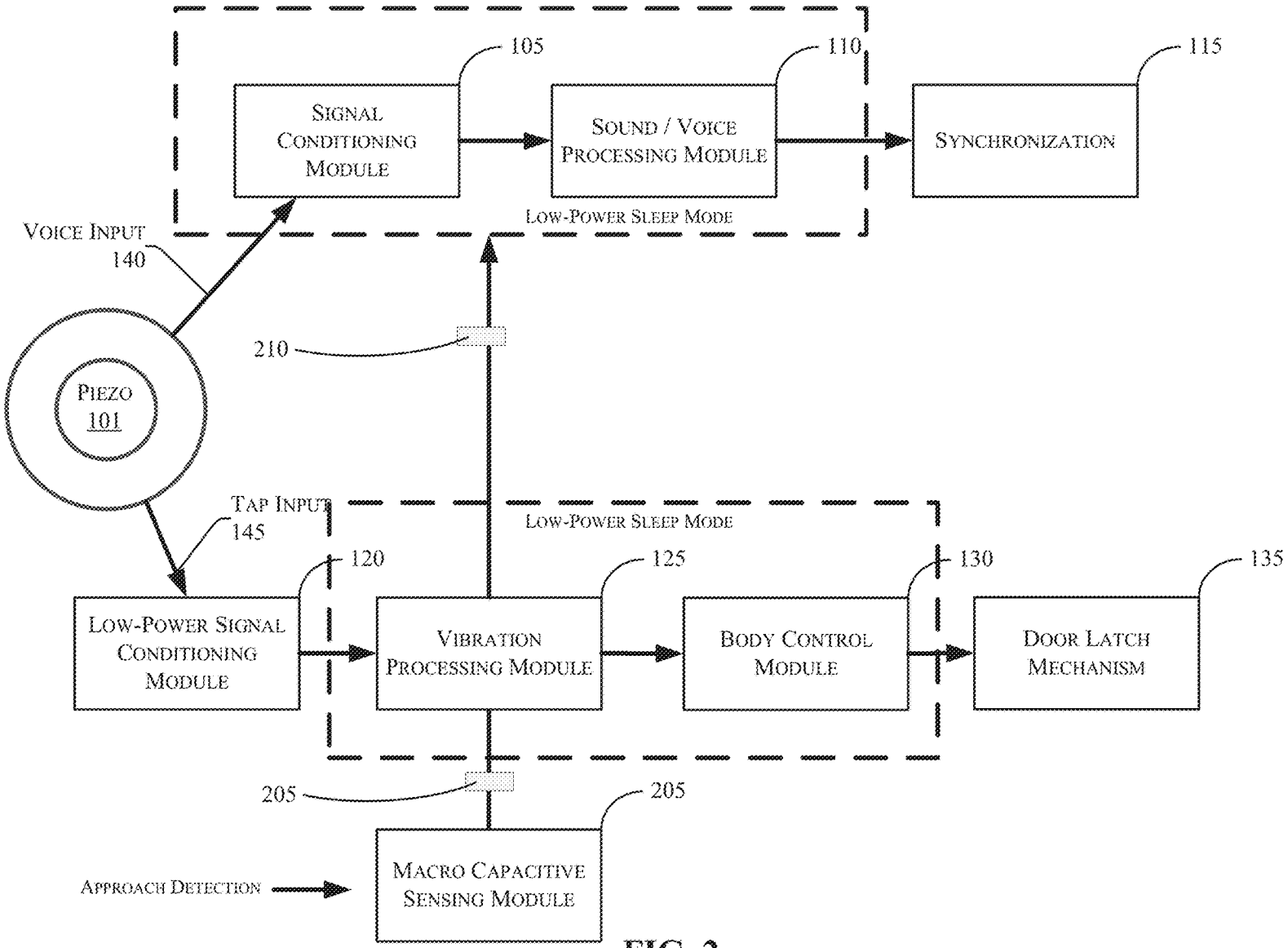
FIG. 2 depicts an example flow diagram for providing vehicle access using the piezoelectric diaphragm transducer microphone access control system in accordance with embodiments of the present disclosure.

FIG. 2 depicts an example process diagram 200 for using an access control system to provide user access to a vehicle (not shown in FIG. 2) while in a sleep mode, in accordance with example embodiments of this disclosure. In one aspect, power consumption may be lowered even further by operating the vibration processing module 125 in the low-power state, and using a vehicle approach detection system such as, for example, a macro capacitive sensing module 205, to detect an approaching user (user not shown in FIG. 2), and sending a wake-up signal 210 to the vibration processing module 125 and the low-power signal conditioning module 205. Responsive to receiving the wake-up signal 210, the system may transition the vibration processing module and low-power signal conditioning module to a high-power state when the macro capacitive sensing module 205 determines that the approaching user is less than a threshold distance from the vehicle. Example threshold distances may be, for example, 1 meter, 2 meters, etc. After entering into a high-power state, the vibration processing module may send a wake-up signal 210 to the sound/voice processing module 110 and/or the signal conditioning module 105, as described with respect to FIG. 1. In other aspects, responsive to recognizing a known sequence of taps associated with a valid PIN code, the BCM may provide access to the vehicle by generating an unlock control signal that causes the door latch mechanism 135 to unlock the door(s).

Figure 3:
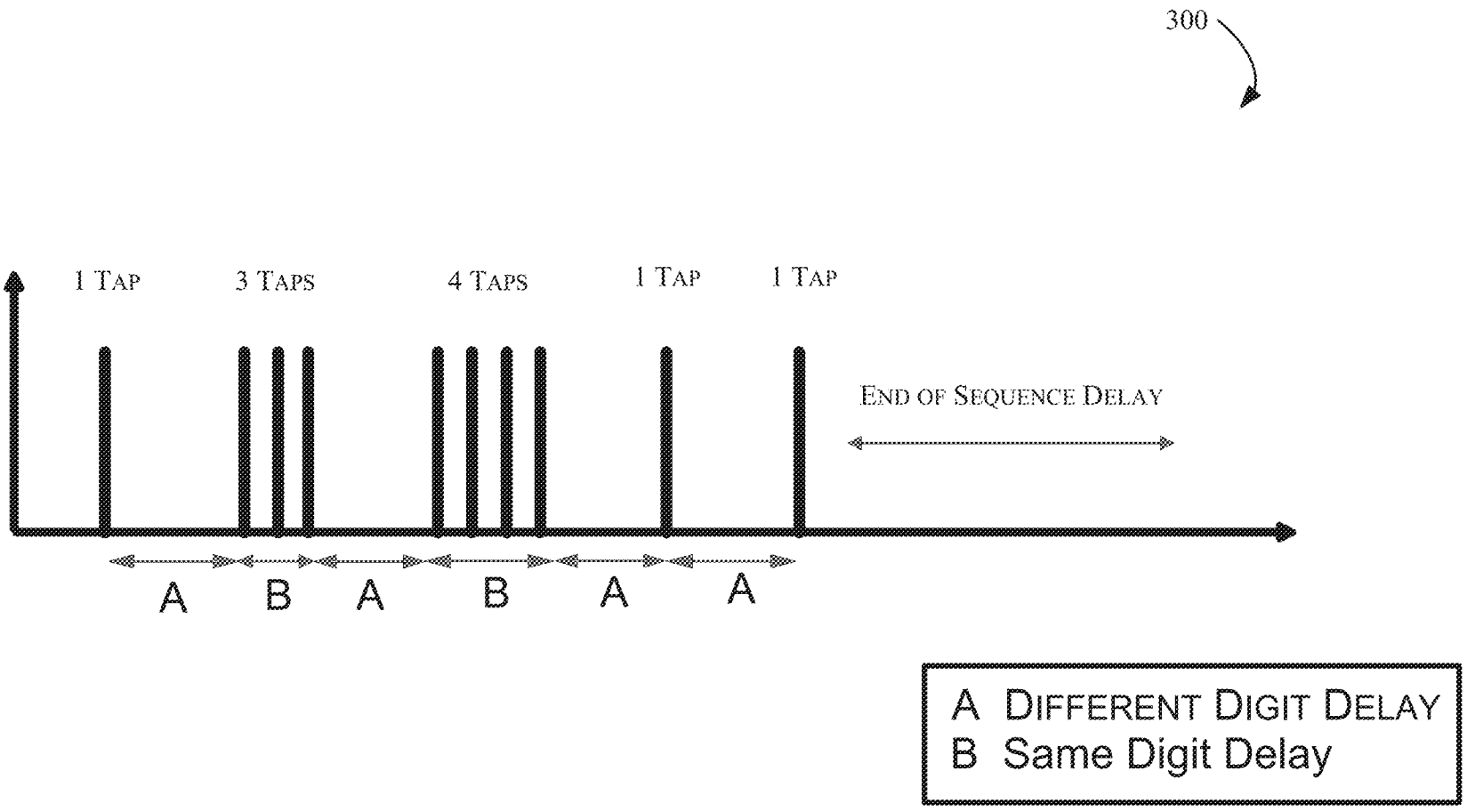
FIG. 3 illustrates a window tap sequence for unlocking the vehicle using a transducer microphone access system in accordance with embodiments of the present disclosure.

FIG. 3 illustrates a window tap sequence for unlocking the vehicle using a transducer microphone access system, in accordance with embodiments of the present disclosure. As described with respect to FIGS. 1 and 2, the vibration processing module 125 may detect a user approaching the vehicle to wake up the system. In another aspect, the vibration processing module 125 may also detect vibratory signals associated with the user manually tapping on the automotive glass. FIG. 3 depicts an example window tap sequence that may be received by the vibration processing module 125, where the vibratory pattern is interpreted to reveal a personal identification number (PIN) code associated with a tap pattern.

In one aspect, the vibration processing module 125 may associate each digit of the PIN code (e.g., a sequence of numbers from 1 to 5) similar to processing key presses on a conventional keypad system, and forward the interpreted PIN code to the BCM 130 as the vibrations are detected. The BCM 130 may determine that the code is correct or incorrect in a similar way to a wired or wireless keypad system.

In one example embodiment, a numeral one may be input with a single tap, followed by a predetermined time span having no taps. In another example, the numeral two may be input with two sequential taps, the numeral three with three sequential taps, etc. The example PIN code entry is depicted in FIG. 3 as numerals 1, 3, 4, 1, 1. Each of the tap sequences is made with a same digit delay B intervening the taps for that numeral. For example, the same digit delay B may be one half second, one quarter second, a span of time between ½ second and 1 second, etc. After taps separated by a same digit delay B are detected, the next set of taps associated with the next sequential digit may be separated from the first set by a different digit delay A. A different digit delay A may be significantly longer than the same digit delay B. For example, the delay A may be a full second, two seconds, etc. When the vibration processing module 125 detects a pause longer than the different digit delay B, the vibration processing module 125 may recognize a new digit. When an "end-of-sequence" delay is observed, which may be significantly longer than the different digit delay A, the vibration processing module 125 may stop processing the tap inputs 145, and reset the interface. In other aspects, responsive to recognizing a known sequence of taps associated with a valid PIN code, the vehicle may trigger the body control module 130 to provide access to the vehicle by triggering an unlock action via the door latch mechanism 135.

To keep the architecture unchanged from the existing keypad entry system, each digit is sent to the body control module as it is detected. The BCM may be responsible for determining whether the resulting PIN is correct.

Figure 4:
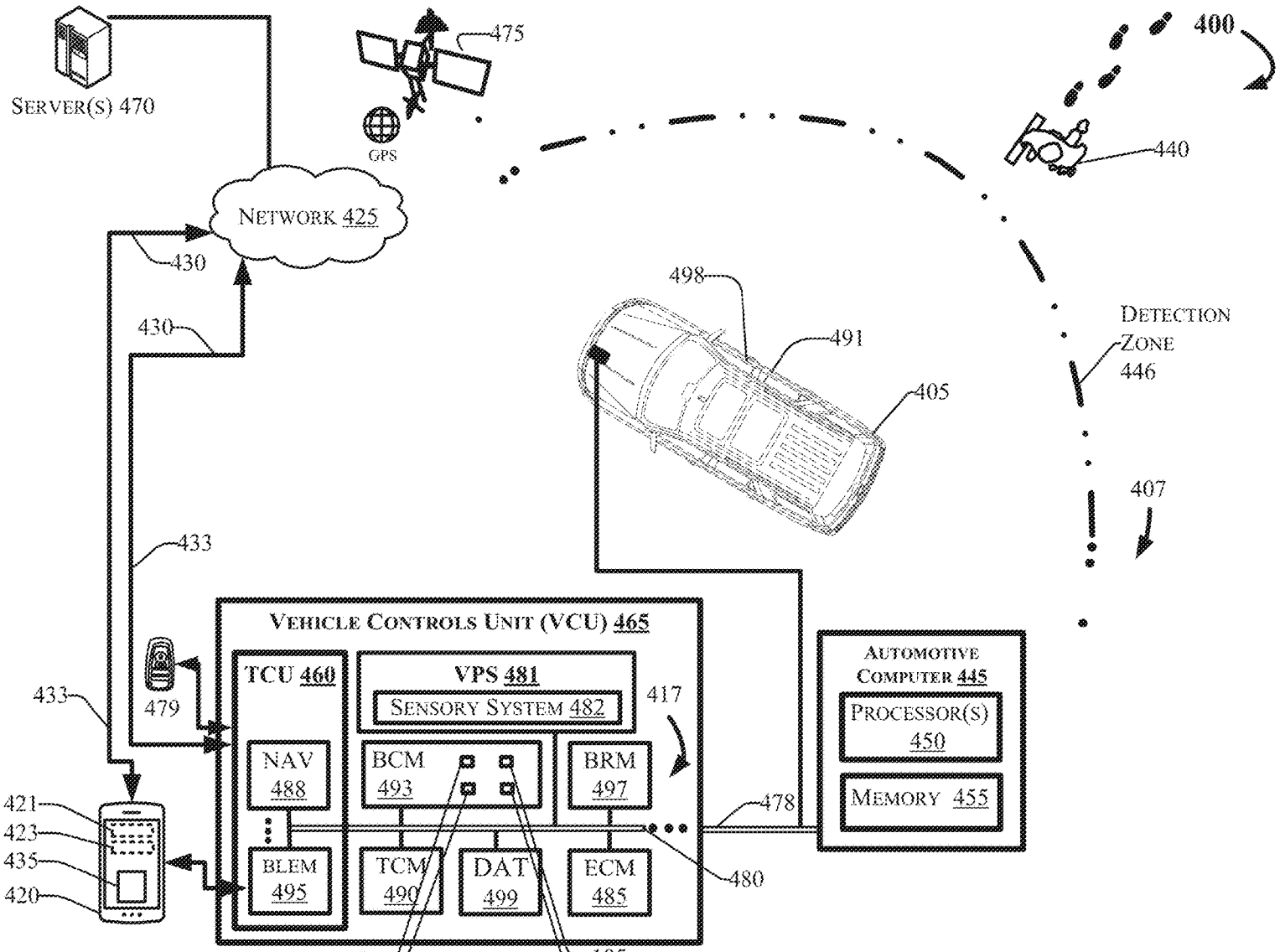
FIG. 4 depicts an example computing environment in which techniques and structures for providing the systems and methods disclosed herein may be implemented.

According to another embodiment, the tap entry system 407 as shown in FIG. 4 may be configured and/or programmed to recognize a teachable tapping rhythmic pattern, such as we often unconsciously do while listening to music. In one aspect, the tap entry system 407 may include an enrollment process in the interface that may train recognition of the specific pattern, attuned to the specific user. This feature may improve positive detection while improving security for the vehicle 405 (as shown in FIG. 4), by rejecting an attempt at mimicking the pattern.

To keep the architecture unchanged from the existing keypad entry system, the module dedicated to detecting a tapping event may also acquire and recognize the entire rhythmic pattern. If the pattern is recognized as valid, then the tap entry system 407 may send a pre-negotiated 5-digit pin to the BCM, which may then unlock the doors by sending a signal to the door latch mechanism(s) via the BCM responsive to determining that the PIN number is correct and valid.

FIG. 4 depicts an example computing environment 400 that can include a vehicle 405. The vehicle 405 may include an automotive computer 445, and a Vehicle Controls Unit (VCU) 465 that can include a plurality of electronic control units (ECUs) 417 disposed in communication with the automotive computer 445. A mobile device 420, which may be associated with a user 440 and the vehicle 405, may connect with the automotive computer 445 using wired and/or wireless communication protocols and transceivers. The mobile device 420 may be communicatively coupled with the vehicle 405 via one or more network(s) 425, which may communicate via one or more wireless connection(s) 430, and/or may connect with the vehicle 405 directly using near field communication (NFC) protocols, Bluetooth® protocols, Wi-Fi, Ultra-Wide Band (UWB), and other possible data connection and sharing techniques.

The vehicle 405 may also receive and/or be in communication with a Global Positioning System (GPS) 475. The GPS 475 may be a satellite system (as depicted in FIG. 4) such as the global navigation satellite system (GLNSS), Galileo, or navigation or other similar system. In other aspects, the GPS 475 may be a terrestrial-based navigation network. In some embodiments, the vehicle 405 may utilize a combination of GPS and Dead Reckoning responsive to determining that a threshold number of satellites are not recognized.

The automotive computer 445 may be or include an electronic vehicle controller, having one or more processor (s) 450 and memory 455. The automotive computer 445 may, in some example embodiments, be disposed in communication with the mobile device 420, and one or more server(s) 470. The server(s) 470 may be part of a cloud-based computing infrastructure, and may be associated with and/or include a Telematics Service Delivery Network (SDN) that provides digital data services to the vehicle 405 and other vehicles (not shown in FIG. 4) that may be part of a vehicle fleet.

Although illustrated as a sport utility, the vehicle 405 may take the form of another passenger or commercial automobile such as, for example, a car, a truck, high performance vehicle, a crossover vehicle, a van, a minivan, a taxi, a bus, etc., and may be configured and/or programmed to include various types of automotive drive systems. Example drive systems can include internal combustion engine (ICEs) powertrains having a gasoline, diesel, or natural gas-powered combustion engine with conventional drive components such as, a transmission, a drive shaft, a differential, etc.

In another configuration, the vehicle 405 may be configured as an electric vehicle (EV). More particularly, the vehicle 405 may include a battery EV (BEV) drive system, or be configured as a hybrid EV (HEV) having an independent onboard powerplant, a plug-in HEV (PHEV) that includes a HEV powertrain connectable to an external power source, and/or includes a parallel or series hybrid powertrain having a combustion engine powerplant and one or more EV drive systems. HEVs may further include a battery and/or supercapacitor banks for power storage, flywheel power storage systems, or other power generation and storage infrastructure. The vehicle 405 may be further configured as a fuel cell vehicle (FCV) that converts liquid or solid fuel to usable power using a fuel cell, (e.g., a hydrogen fuel cell vehicle (HFCV) powertrain, etc.) and/or any combination of these drive systems and components.

Further, the vehicle 405 may be a manually driven vehicle, and/or be configured and/or programmed to operate in a fully autonomous (e.g., driverless) mode (e.g., Level-5 autonomy) or in one or more partial autonomy modes which may include driver assist technologies. Examples of partial autonomy (or driver assist) modes are widely understood in the art as autonomy Levels 1 through 4.

The mobile device 420 can include a memory 423 for storing program instructions associated with an application 435 that, when executed by a mobile device processor 421, performs aspects of the disclosed embodiments. The application (or "app") 435 may be part of the tap entry system 407, or may provide information to the tap entry system 407 and/or receive information from the tap entry system 407.

In some aspects, the mobile device 420 may communicate with the vehicle 405 through the one or more wireless connection(s) 430, which may be encrypted and established between the mobile device 420 and a Telematics Control Unit (TCU) 460. The mobile device 420 may communicate with the TCU 460 using a wireless transmitter (not shown in FIG. 4) associated with the TCU 460 on the vehicle 405. The transmitter may communicate with the mobile device 420 using a wireless communication network such as, for example, the one or more network(s) 425. The wireless connection(s) 430 are depicted in FIG. 4 as communicating via the one or more network(s) 425, and via one or more wireless connection(s) 433 that can be direct connection(s) between the vehicle 405 and the mobile device 420. The wireless connection(s) 433 may include various low-energy protocols including, for example, Bluetooth®, Bluetooth® Low-Energy (BLE®), UWB, Near Field Communication (NFC), or other protocols.

The network(s) 425 illustrate an example communication infrastructure in which the connected devices discussed in various embodiments of this disclosure may communicate. The network(s) 425 may be and/or include the Internet, a private network, public network or other configuration that operates using any one or more known communication protocols such as, for example, transmission control protocol/Internet protocol (TCP/IP), Bluetooth®, BLE®, Wi-Fi based on the Institute of Electrical and Electronics Engineers (IEEE) standard 802.11, UWB, and cellular technologies such as Time Division Multiple Access (TDMA), Code Division Multiple Access (CDMA), High Speed Packet Access (HSPDA), Long-Term Evolution (LTE), Global System for Mobile Communications (GSM), and Fifth Generation (5G), to name a few examples.

The automotive computer 445 may be installed in an engine compartment of the vehicle 405 (or elsewhere in the vehicle 405) and operate as a functional part of the tap entry system 407, in accordance with the disclosure. The automotive computer 445 may include one or more processor(s) 450 and a computer-readable memory 455.

The one or more processor(s) 450 may be disposed in communication with one or more memory devices disposed in communication with the respective computing systems (e.g., the memory 455 and/or one or more external databases not shown in FIG. 4). The processor(s) 450 may utilize the memory 455 to store programs in code and/or to store data for performing aspects in accordance with the disclosure. The memory 455 may be a non-transitory computer-readable memory storing a keyless vehicle access program code. The memory 455 can include any one or a combination of volatile memory elements (e.g., dynamic random access memory (DRAM), synchronous dynamic random-access memory (SDRAM), etc.) and can include any one or more nonvolatile memory elements (e.g., erasable programmable read-only memory (EPROM), flash memory, electronically erasable programmable read-only memory (EEPROM), programmable read-only memory (PROM), etc. In some aspects, the memory 455 may include a tap entry system 407.

The VCU 465 may share a power bus 478 with the automotive computer 445, and may be configured and/or programmed to coordinate the data between vehicle 405 systems, connected servers (e.g., the server(s) 470), and other vehicles (not shown in FIG. 4) operating as part of a vehicle fleet. The VCU 465 can include or communicate with any combination of the ECUs 417, such as, for example, a Body Control Module (BCM) 493, an Engine Control Module (ECM) 485, a Transmission Control Module (TCM) 490, the TCU 460, a Driver Assistances Technologies (DAT) controller 499, etc. The VCU 465 may further include and/or communicate with a Vehicle Perception System (VPS) 481, having connectivity with and/or control of one or more vehicle sensory system(s) 482. In some aspects, the VCU 465 may control operational aspects of the vehicle 405, and implement one or more instruction sets received from the application 435 operating on the mobile device 420, from one or more instruction sets stored in computer memory 455 of the automotive computer 445, including instructions operational as part of the tap entry system 407.

The TCU 460 can be configured and/or programmed to provide vehicle connectivity to wireless computing systems onboard and offboard the vehicle 405, and may include a Navigation (NAV) receiver 488 for receiving and processing a GPS signal from the GPS 475, a BLE® Module (BLEM) 495, a Wi-Fi transceiver, a UWB transceiver, and/or other wireless transceivers (not shown in FIG. 4) that may be configurable for wireless communication between the vehicle 405 and other systems, computers, and modules. The TCU 460 may be disposed in communication with the ECUs 417 by way of a bus 480. In some aspects, the TCU 460 may retrieve data and send data as a node in a CAN bus.

The BLEM 495 may establish wireless communication using Bluetooth® and BLE® communication protocols by broadcasting and/or listening for broadcasts of small advertising packets, and establishing connections with responsive devices that are configured according to embodiments described herein. For example, the BLEM 495 may include Generic Attribute Profile (GATT) device connectivity for client devices that respond to or initiate GATT commands and requests, and connect directly with the mobile device 420, and/or one or more keys (which may include, for example, the fob 479).

The bus 480 may be configured as a Controller Area Network (CAN) bus organized with a multi-master serial bus standard for connecting two or more of the ECUs 417 as nodes using a message-based protocol that can be configured and/or programmed to allow the ECUs 417 to communicate with each other. The bus 480 may be or include a high-speed CAN (which may have bit speeds up to 1 Mb/s on CAN, 5 Mb/s on CAN Flexible Data Rate (CAN FD)), and can include a low-speed or fault tolerant CAN (up to 125 Kbps), which may, in some configurations, use a linear bus configuration. In some aspects, the ECUs 417 may communicate with a host computer (e.g., the automotive computer 445, the tap entry system 407, and/or the server(s) 470, etc.), and may also communicate with one another without the necessity of a host computer. The bus 480 may connect the ECUs 417 with the automotive computer 445 such that the automotive computer 445 may retrieve information from, send information to, and otherwise interact with the ECUs 417 to perform steps described according to embodiments of the present disclosure. The bus 480 may connect CAN bus nodes (e.g., the ECUs 417) to each other through a two-wire bus, which may be a twisted pair having a nominal characteristic impedance. The bus 480 may also be accomplished using other communication protocol solutions, such as Media Oriented Systems Transport (MOST) or Ethernet. In other aspects, the bus 480 may be a wireless intra-vehicle bus.

The VCU 465 may control various loads directly via the bus 480 communication or implement such control in conjunction with the BCM 493. The ECUs 417 described with respect to the VCU 465 are provided for example purposes only, and are not intended to be limiting or exclusive. Control and/or communication with other control modules not shown in FIG. 4 is possible, and such control is contemplated.

In an example embodiment, the ECUs 417 may control aspects of vehicle operation and communication using inputs from human drivers, inputs from an autonomous vehicle controller, the tap entry system 407, and/or via wireless signal inputs received via the wireless connection (s) 433 from other connected devices such as the mobile device 420, among others. The ECUs 417, when configured as nodes in the bus 480, may each include a central processing unit (CPU), a CAN controller, and/or a transceiver (not shown in FIG. 4). For example, although the mobile device 420 is depicted in FIG. 4 as connecting to the vehicle 405 via the BLEM 495, it is possible and contemplated that the wireless connection 433 may also or alternatively be established between the mobile device 420 and one or more of the ECUs 417 via the respective transceiver(s) associated with the module(s).

The BCM 493 generally includes integration of sensors, vehicle performance indicators, and variable reactors associated with vehicle systems, and may include processor-based power distribution circuitry that can control functions associated with the vehicle body such as lights, windows, security, door locks and access control, and various comfort controls. The BCM 493 may also operate as a gateway for bus and network interfaces to interact with remote ECUs (not shown in FIG. 4). In one aspect, the BCM 493 may include and/or operate a transducer controller.

The BCM 493 may coordinate any one or more functions from a wide range of vehicle functionality, including energy management systems, alarms, vehicle immobilizers, driver and rider access authorization systems, Phone-as-a-Key (PaaK) systems, driver assistance systems, AV control systems, power windows, doors, actuators, and other functionality, etc. The BCM 493 may be configured for vehicle energy management, exterior lighting control, wiper functionality, power window and door functionality, heating ventilation and air conditioning systems, and driver integration systems. In other aspects, the BCM 493 may control auxiliary equipment functionality, and/or be responsible for integration of such functionality.

Although the present embodiments are configured such that a keypad entry system may not be needed, in some aspects, the vehicle 405 may include one or more Door Access Panels (DAPs) 491 disposed on exterior door surface (s) of vehicle door(s) 498, and connected with a DAP controller (not shown in FIG. 4). In some aspects, the user 440 may have the option of entering a vehicle by typing in a personal identification number (PIN) on an exterior interface associated with a vehicle. The user interface may be included as part of a Door Access Panel (DAP) 491, a wireless keypad, included as a part of the mobile device 420, or included as part of another interface. The DAP 491, which may operate and/or communicate with the BCM 493 or another of the ECUs 417, can include and/or connect with an interface with which a ridehail passenger, user, (or any other user such as the user 440) may input identification credentials and receive information from the system. In one aspect, the interface may be or include a DAP 491 disposed on a vehicle door 498, and can include an interface device from which the user can interact with the system by selecting their unique identifier from a list, and by entering personal identification numbers (PINs) and other non-personally identifying information. In some embodiments, the interface may be a mobile device, a keypad, a wireless or wired input device, a vehicle infotainment system, and/or the like. In other embodiments described herein, the interface may be the automotive glass configured as a virtual keypad. Accordingly, it should be appreciated that, although a DAP is described with respect to embodiments herein, the interface may alternatively be one or more other types of interfaces described above.

The BCM 493, can include sensory and processor functionality and hardware to facilitate user and device authentication, and provide occupant customizations and support that provide customized experiences for vehicle occupants. The BCM 493 may connect with a Driver Assistance Technologies (DAT) controller 499 configured and/or programmed to provide biometric authentication controls, including, for example, facial recognition, fingerprint recognition, voice recognition, and/or other information associated with characterization, identification, and/or verification for other human factors such as gait recognition, body heat signatures, eye tracking, etc. In some aspects, the BCM 493 may include communication with a macrocapacitive sensor system that may determine when the user 440 is approaching the vehicle, and responsive to determining that approach (or proximity to the vehicle 405), transition one or more systems from a low-power state to a high-power state.

The DAT controller 499 may provide Level-1 through Level-3 automated driving and driver assistance functionality that can include, for example, active parking assistance, trailer backup assistance, adaptive cruise control, lane keeping, and/or driver status monitoring, among other features. The DAT controller 499 may also provide aspects of user and environmental inputs usable for user authentication. Authentication features may include, for example, biometric authentication and recognition.

The DAT controller 499 can obtain input information via the sensory system(s) 482, which may include sensors disposed on the vehicle interior and/or exterior (sensors not shown in FIG. 4). The DAT controller 499 may receive the sensor information associated with driver functions, vehicle functions, and environmental inputs, and other information. The DAT controller 499 may characterize the sensor information for identification of biometric markers stored in a secure biometric data vault (not shown in FIG. 4) onboard the vehicle 405 and/or via the server(s) 470.

In other aspects, the DAT controller 499 may also be configured and/or programmed to control Level-1 and/or Level-2 driver assistance when the vehicle 405 includes Level-1 or Level-2 autonomous vehicle driving features. The DAT controller 499 may connect with and/or include a Vehicle Perception System (VPS) 481, which may include internal and external sensory systems (collectively referred to as sensory systems 482). The sensory systems 482 may be configured and/or programmed to obtain sensor data usable for biometric authentication, and for performing driver assistance operations such as, for example, active parking, trailer backup assistance, adaptive cruise control and lane keeping, driver status monitoring, and/or other features. In some aspects, the VPS 481 may include the piezoelectric diaphragm transducer microphone 101 as shown in FIG. 1.

The vehicle PaaK system (not shown in FIG. 4) determines and monitors a location for a PaaK-enabled mobile device relative to the vehicle location in order to time broadcasting a pre-authentication message to the mobile device 420, or other passive key device such as the fob 479. As the mobile device 420 approaches a predetermined communication range relative to the vehicle position (e.g., a detection zone 446) the mobile device 420 may transmit a preliminary response message to the PaaK-enabled vehicle. The vehicle PaaK system may cache the preliminary response message until a user associated with the authenticating device performs an unlock action such as actuating a vehicle door latch/unlatch mechanism by pulling a door handle, for example. The PaaK system may unlock the door using data already sent to the pre-processor to perform a first level authentication without the delay associated with full authentication steps. In one aspect, the vehicle PaaK may also function as a user proximity locator that causes the tap access system 407 to transition from a low-power state to a high-power state responsive to determining that the user is proximate to the vehicle 405.

In other aspects, the VPS may determine that a user is approaching the vehicle using the piezoelectric diaphragm transducer microphone 101. For example, the piezoelectric diaphragm transducer microphone 101, a macrocapacitive system (not shown in FIG. 4), or another sensory system device of the VPS may determine that the user 440 is approaching the vehicle 405.

After actuation of the door latch, the PaaK system may perform post-authentication confirmation using a secure processor, by transmitting, to the requesting device, a validation message that includes a challenge value requiring a validation response from the requesting device, and authenticating responsive validation messages using the secure processor. Responsive messages that correctly answer the validation message may confirm authenticity of the requesting device, and no further mitigating action is taken.

The processor(s) 450 may provide initial access to the vehicle 405 when the mobile device 420 is within the detection zone 446. Determining that the mobile device 420 is proximate to the vehicle 405 and within the PEPS zone, in conjunction with one or more other triggers, may cause pre-authorization steps to begin. For example, the processor (s) 450 may generate a secure processor initialization instruction responsive to a door latch opening, or a user touching the sensory area of a door handle or keyless entry keypad, or presence detection through cameras or other electromagnetic sensing. The processor(s) 450 may receive a sensor output that indicates an attempt to enter the vehicle.

Figure 5:
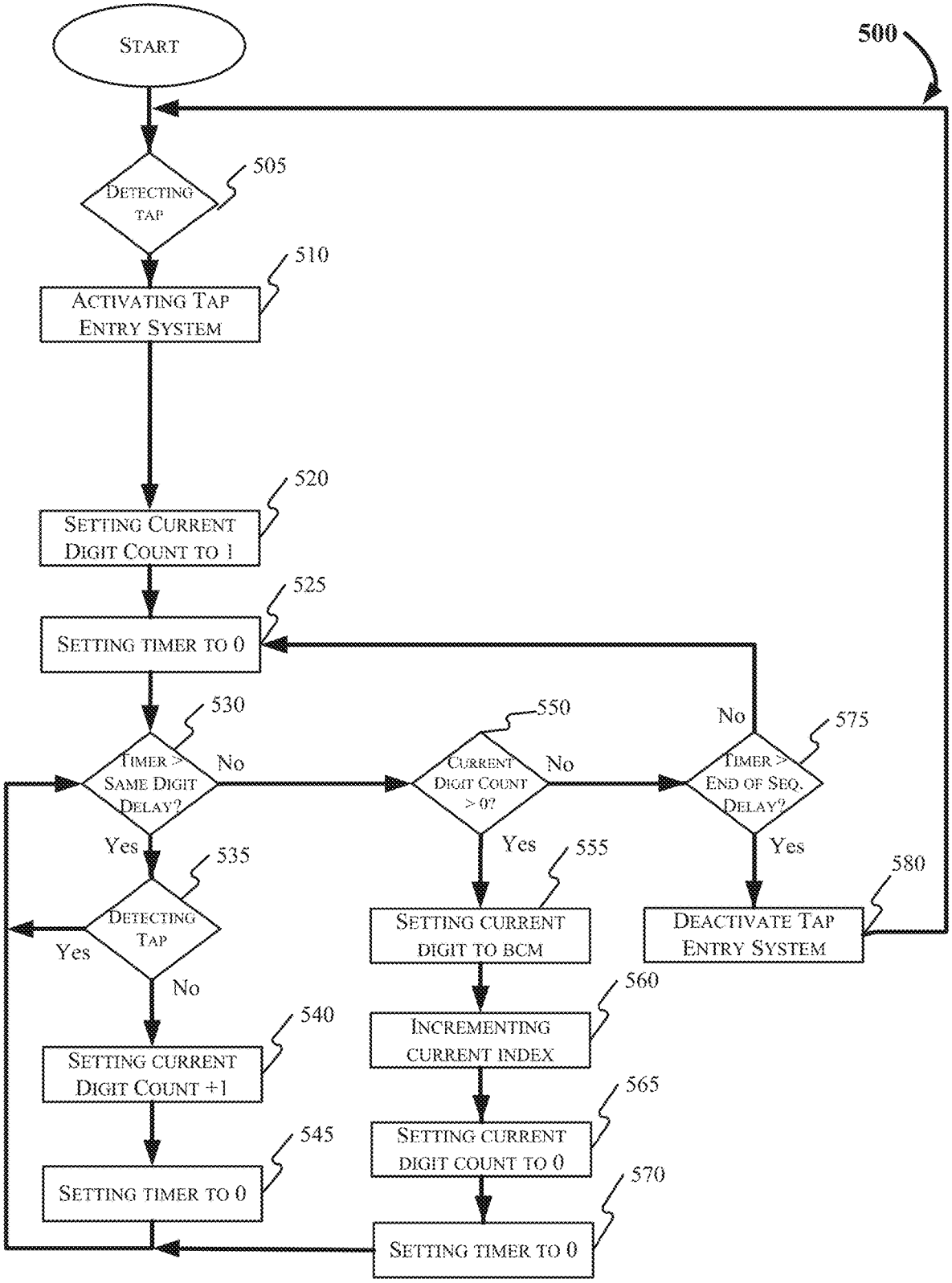
FIG. 5 depicts a flow diagram of an example method for unlocking the vehicle using a transducer microphone access system in accordance with the present disclosure.

With reference to FIG. 5, at step 505, the method 500 may commence with detecting an exterior tap on one or more vehicle windows. For example, a user may tap a door window with one or more fingers to activate the vehicle entry system.

At step 510, the method 500 may further include activating the tap entry system responsive to receiving one or more vibrations associated with the user's tap on the automotive glass. This step may include initializing the tap entry system to determine if a sequence of taps corresponds to a valid user PIN code.

In the following steps 520 to 525, the system may perform a system reset that sets indices to zero, timers to zero, and initiation of a system count function. With reference first to step 520, the method 500 may include setting a current digit count to 1, which may keep track of which digit of a series of digits the input references.

At step 525, the method 500 may further include setting a timer to 0. The timer may keep track of time intervals between taps, as described with respect to FIG. 3.

At step 530, the method 500 may further include determining if the timer is greater than the same digit delay (e.g., the same digit delay "B" described with respect to FIG. 3). Responsive to determining that the timer is greater than the same digit delay, at step 535, the method includes determining if another tap is detected.

At step 540, responsive to determining that another tap is not detected, the method includes setting the current digit count to +1 (essentially, incrementing the digit count). Responsive to determining that a tap is detected at step 535, the system may return to step 530. At step 545, the method may also reset the timer to 0, and return the logic to step 530, where the system determines whether the timer is greater than the same digit delay.

Referring again to step 530, responsive to determining that the timer is less than the same digit delay, the method 500 may include determining if the current digit count is greater than 0 (at step 550). If the digit count is 1 or more, at step 555 the method includes setting the current digit to BCM at step 555.

At step 560, the method 500 includes incrementing the current index.

At step 565, the method includes setting the current digit count to 0, and at step 570, setting the timer to 0.

Referring again to decision block 550, responsive to determining that the current digit count is not greater than 0, at step 575 the method 500 may include determining whether the timer is greater than the end of sequence delay. Responsive to determining that it is greater, at step 580, the method may deactivate the tap entry system 407. Responsive to determining that the timer is not greater than the end of sequence delay at step 575, the method 500 may include returning to step 525, where the system sets the timer to 0.

At step 570, after setting the timer to 0, the method may include returning to decision block 530, where the system determines whether the timer is greater than the same digit delay.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description and claims refer to particular system components. As one skilled in the art will appreciate, components may be referred to by different names. This document does not intend to distinguish between components that differ in name, but not function.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Computing devices may include computer-executable instructions, where the instructions may be executable by one or more computing devices such as those listed above and stored on a computer-readable medium.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A method for unlocking a vehicle via a piezoelectric diaphragm transducer microphone, comprising:

detecting, via a low-power signal conditioning module and the piezoelectric diaphragm transducer microphone, one or more mechanical vibration inputs through a vehicle window, wherein the one or more mechanical vibration inputs are associated with at least one tap on a glass window of the vehicle, and wherein the low-power signal conditioning module is kept in an active mode while the vehicle is off;

waking up, responsive to the one or more mechanical vibration inputs detected by the low-power signal conditioning module and the piezoelectric diaphragm transducer microphone, a sound/voice processing module, wherein the sound/voice processing module is configured to detect voice inputs for vehicle entry;

detecting, via the sound/voice processing module or a vibration processing module, a voice input or a vibratory pattern through the vehicle window, wherein a sequence of a portion of the vibratory pattern is indicative of a number, and the sequence is associated with a same first digit delay intervening the one or more mechanical vibration inputs;

determining, based on the vibratory pattern or the voice input, authentication for vehicle entry; and unlocking, based on the authentication, a door of the vehicle.

2. The method according to claim 1, wherein the sequence is a first sequence, wherein the vibratory pattern further comprises a second sequence, and wherein the first sequence is separated from the second sequence by a second digit delay that is longer than the first digit delay.

3. The method according to claim 2, wherein the vibratory pattern comprises a PIN code associated with a tap pattern matching a user-defined musical rhythm.

4. The method according to claim 1, wherein the vibratory pattern comprises a PIN code associated with a tap pattern.

5. The method according to claim 1, wherein the vibratory pattern is further associated with a verbal password.

6. The method according to claim 1, further comprising:

determining that a user is approaching the vehicle; and transitioning the low-power signal conditioning module and the vibration processing module to a high-power state responsive to the determination that the user is approaching the vehicle.

7. A system for unlocking a vehicle, comprising:

a piezoelectric diaphragm transducer microphone; and a processor; and a memory for storing executable instructions, the processor programmed to execute the instructions to:

detect, via a low-power signal conditioning module and the piezoelectric diaphragm transducer microphone, one or more mechanical vibration inputs through a vehicle window, wherein the one or more mechanical vibration inputs are associated with at least one tap on a glass window of the vehicle, and wherein the low-power signal conditioning module is kept in an active mode while the vehicle is off;

wake up, responsive to the one or more mechanical vibration inputs detected by the low-power signal conditioning module and the piezoelectric diaphragm transducer microphone, a sound/voice processing module, wherein the sound/voice processing module is configured to detect voice inputs for vehicle entry;

detect, via the sound/voice processing module or a vibration processing module, a voice input or a vibratory pattern through the vehicle window, wherein a sequence of a portion of the vibratory pattern is indicative of a number, and the sequence is associated with a same first digit delay intervening the one or more mechanical vibration inputs;

determine, based on the vibratory pattern or the voice input, authentication for vehicle entry; and unlock, based on the authentication, a door of the vehicle.

8. The system according to claim 7, wherein the sequence is a first sequence, and wherein the vibratory pattern further comprises a second sequence, and wherein the first sequence is separated from the second sequence by a second digit delay that is longer than the first digit delay.

9. The system according to claim 7, wherein the vibratory pattern comprises a PIN code associated with a tap pattern.

10. The system according to claim 9, wherein the vibratory pattern comprises a PIN code associated with a tap pattern matching a user-defined musical rhythm.

11. The system according to claim 7, wherein the vibratory pattern is associated with a verbal password.

12. The system according to claim 7, wherein the processor is further configured to:

determine that a user is approaching the vehicle; and transitioning the low-power signal conditioning module and the vibration processing module to a high-power state responsive to the determination that the user is approaching the vehicle.

13. A non-transitory computer-readable storage medium having instructions stored thereupon which, when executed by a processor, cause the processor to:

receive an indication of a user approaching a vehicle;

detect, via a low-power signal conditioning module and the piezoelectric diaphragm transducer microphone, one or more mechanical vibration inputs through a vehicle window, wherein the one or more mechanical vibration inputs are associated with at least one tap on a glass window of the vehicle, and wherein the low-power signal conditioning module is kept in an active mode while the vehicle is off;

wake up, responsive to the one or more mechanical vibration inputs detected by the low-power signal conditioning module and the piezoelectric diaphragm transducer microphone, a sound/voice processing module, wherein the sound/voice processing module is configured to detect voice inputs for vehicle entry;

detect, via the sound/voice processing module or a vibration processing module, a voice input or a vibratory pattern through the vehicle window, wherein a sequence of a portion of the vibratory pattern is indicative of a number, and the sequence is associated with a same first digit delay intervening the one or more mechanical vibration inputs;

determine, based on the vibratory pattern or the voice input, authentication for vehicle entry; and generate, based on the authentication, a control command for unlocking a door of the vehicle.

14. The storage medium according to claim 13, having further instructions stored thereupon to cause the processor to:

operate the piezoelectric diaphragm transducer microphone in a low-power state;

determine that the user is less than a threshold distance from the vehicle;

transition the piezoelectric diaphragm transducer microphone, the low-power signal conditioning module, and the sound/voice processing module to a high-power state responsive to determining that the user is less than the threshold distance from the vehicle; and receive the vibratory pattern from the piezoelectric diaphragm transducer microphone while in the high-power state.

15. The storage medium according to claim 14, wherein the sequence is a first sequence, wherein the vibratory pattern comprises a second sequence of the one or more mechanical vibration inputs, and wherein the first sequence is separated from the second sequence by a second digit delay that is longer than the first digit delay.

16. The storage medium according to claim 15, wherein the vibratory pattern comprises a PIN code associated with a tap pattern matching a user-defined musical rhythm.

17. The storage medium according to claim 14, wherein the vibratory pattern comprises a PIN code associated with a tap pattern.

18. The storage medium according to claim 13, wherein the vibratory pattern is associated with a verbal password spoken by the user.

* * * * *